US006545585B2

(12) United States Patent
Endo et al.

(10) Patent No.: US 6,545,585 B2
(45) Date of Patent: Apr. 8, 2003

(54) FUSE

(75) Inventors: Takayoshi Endo, Shizuoka (JP); Takahiro Sato, Shizuoka (JP); Hiroki Kondo, Shizuoka (JP); Norihiro Ohashi, Shizuoka (JP); Goro Nakamura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 78 days.

(21) Appl. No.: 09/801,801

(22) Filed: Mar. 9, 2001

(65) Prior Publication Data

US 2001/0028293 A1 Oct. 11, 2001

(30) Foreign Application Priority Data

Apr. 6, 2000 (JP) ..... 2000-104927

(51) Int. Cl.[7] ..... H01H 85/08; H01H 85/153; H01H 85/143

(52) U.S. Cl. ..... 337/260; 337/231; 337/234; 337/252; 337/260; 439/622; 439/890

(58) Field of Search ..... 337/186, 187, 337/228, 231, 234, 251, 252, 260, 262, 290, 295; 29/623; 439/621, 622, 830, 890, 893

(56) References Cited

U.S. PATENT DOCUMENTS 3,775,724 A * 11/1973 Mamrick et al. ..... 337/187
3,909,767 A * 9/1975 Williamson et al. ..... 337/198
4,344,060 A * 8/1982 Ciesemier et al. ..... 29/623
4,580,124 A 4/1986 Borzoni
4,604,602 A * 8/1986 Borzoni ..... 337/198
4,661,793 A 4/1987 Borzoni
4,670,729 A * 6/1987 Oh ..... 337/255
4,831,353 A * 5/1989 Gaia et al. ..... 29/623
4,998,086 A * 3/1991 Kourinsky et al. ..... 337/255
5,239,282 A * 8/1993 Filomia ..... 337/255
5,507,669 A * 4/1996 Jannett et al. ..... 337/256
5,668,522 A * 9/1997 Kondo et al. ..... 337/160

FOREIGN PATENT DOCUMENTS

JP 57-210537 A * 12/1982 ..... H01H/85/56
JP 61-294730 A * 12/1986 ..... H01H/85/20
JP 05-205608 A * 8/1993 ..... H01H/85/20
JP 7-20828 5/1995

* cited by examiner

*Primary Examiner*—Anatoly Vortman
(74) *Attorney, Agent, or Firm*—Armstrong, Westerman & Hattori, LLP

(57) ABSTRACT

A fuse 1 includes a pair of terminals 2, housing 4 and fusible body 5. The terminals 2 are provided so that their one ends are housed in the housing 4 and their other ends are exposed externally from the housing 4. The terminals 2 each has a recess to enlarge the interval therebetween. The recess 6 consists of a flat face 10 and step face 11. The housing 4 includes a pair of end walls 12*a*, 12*b*, and a pair of partition walls 22. The inner faces 15*a*, 15*b* of the pair of end walls 12*a*, 12*b* are opposite to each other in a direction orthogonal to the direction the pair of terminals are arranged in parallel and extend along the end faces of the terminals 2. The partition wall extend from the inner face 15*b* toward the inner face 15*a*. The second partition walls each covers the flat face 10. In this configuration, when the power with a current value which exceeds the fusing current value of the fusible body is supplied, supply of the power to the load can be surely stopped.

5 Claims, 6 Drawing Sheets

FUSE

BACKGROUND OF THE INVENTION

1. Field of the Invention

This invention relates to fuse, and more particularly to a fuse capable of surely stopping power supply to a load.

2. Description of the Related Art

A motor vehicle which is a moving body includes a large number of power transmission lines for transmitting power itself and various signals, such as bus bars in electric connection boxes (junction block, relay box, fuse block, etc.), terminals for connectors for electric connection.

The main tendency of the voltage of the power transmitted along the power transmission line is 12 V for a general passenger car, and 24 V (12×2) for a large scale vehicle such as a bus or truck . However, particularly for the passenger car, it has been proposed to adopt a power system for supplying an electric power with a higher voltage value than before in view of demands of improvement in driving efficiency of loads and driving with at an optimum efficiency for each load.

The above power transmission line includes fuse blocks from which a large number of fuses can be removed in order to protect electric circuits for various electric appliances (since the fuse block may have a relay or bus bar, it is referred to as a relay box or junction block, or generally referred to as "electric connection box". In this specification, the above fuse block, relay box, junction block are generally referred to as "electric connection block.

The fuse which has been conventionally used for the electric connection block is such a fuse 51 as shown in FIGS. 8 and 9. The fuse 51 includes a pair of terminals 52 arranged in parallel, a housing 54 which houses one ends 53 of these terminals 52 and a fusible body 55 which is formed integrally to the pair of terminals 52 and connect them to each other.

When the fuse 51 is mounted in the electric connection box, the terminals 52 are electrically connected to receiving terminals of the box, respectively. One of the receiving terminals is supplied with an electric power whereas the other thereof is electrically connected to various loads. Thus, the one of the terminal 52 is supplied with the electric power through the receiving terminal whereas the other thereof is connected to the loads. The terminals 52 are housed within the housing 54 in a state where their inner faces 61 are opposite to each other.

The housing 54 is made of insulating synthetic resin. The housing 54 is formed in a box shape. The interior of the housing 54 constitutes a housing chamber within which the one ends of the above pair of terminals 52 are housed.

The fusible body 55 connects the one ends 53 of the terminals 52 to each other. The fusible body 55 is coupled at its both ends with the inner faces 61 which are located at the one ends 53 of the terminals 52. The fusible body 55 includes a fusing portion 62 which fuses when the current value of the electric power supplied from the one of the terminals 52 exceeds a prescribed current value. The fusible portion 62 is formed to have a small sectional area of the fusible body 55.

Where the fuse 51 thus configured is mounted on the electric connecting box, when the current value of the electric power supplied from the one of the terminals 52 through the one receiving terminal exceeds the prescribed current value, the fusing portion 62 of the fusible portion 55 fuses to stop supply of the electric power to the load.

In the fuse 51 shown in FIG. 8, since the fusible 55 is coupled with the opposite inner faces of the terminals 52, there is a relatively small space 60 (FIG. 8) in which the fused potion 62 of the fusible body 55 formed between the inner faces 61 within the housing chamber can scatter. Further, it is generally known that the fusing portion 62 of the fusible body 55 scatters higher momentum as the current value in fusing increases.

In the above conventional fuse 51, when the fusing potion 62 of the fusible body 55 fuses with a higher current value than before, it scatters with higher momentum. In this case, the fusible body 55 thus fused may be deposited on the inner faces 61 constituting the space 60, i.e. surfaces of the terminals 52.

Thus, the fuse deposited may short-circuit the terminals to each other within the space 60. This means difficulty of assuring the insulation between the terminals 52. In this case, supply of the electric power to the load which should be stopped may continue, and therefore the electric power with an excessive current value may be supplied to the load.

SUMMARY OF THE INVENTION

An object of this invention is to provide a fuse which can surely stop supply of an electric power to a load when the electric power with the current which exceeds a current value of fusing a fusible body is supplied.

In order to attain the above object of this invention, in accordance with this invention, there is provided a fuse including a pair of terminals arranged in parallel, a housing having a housing chamber for housing respective one ends thereof and a fusible body for coupling the pair of terminals with each other, wherein the other ends of the pair of terminals are exposed from the housing and at least one of the pair of terminals has an interval increasing portion where the interval between the one ends of the terminals is made longer than that between the other ends of the terminals.

In this configuration, since the interval between the one ends of the terminals is longer than that between the other ends of the terminals, the space where the fusible body can be scattered more widely.

Preferably, the housing includes protecting portion for protecting the inner faces of the opposite one ends of the pair of terminals. This prevents the fused fusible body from being deposited on the inner face of the terminal.

Preferably, the housing includes a pair of inner walls opposite in a direction vertically crossing the direction the pair of terminals are arranged in parallel, and the protecting portion is walls which extend from the one of the inner walls to the other thereof. In this configuration, since the protecting portion is walls which extend from the one of the inner walls to the other thereof, the inner face of the one end of the terminal can be protected more surely.

A plurality of fuses are mounted in an electric connection box, and adjacent ones of the fuses are insulated from each other by an insulating means. In this configuration, the fuses can be connected to an appliance and load connected to the electric connection box in accordance with a desired pattern.

Preferably, the insulating means is an outer wall of the housing. Therefore, adjacent ones of the fuses mounted in the connection box are insulated from each other more surely.

the housing includes an outer wall having a window from which the one end of each the terminals is exposed externally.

In this configuration, assuming that the width of the fuse itself in a direction the terminals are arranged is fixed, the interval between the terminals can be increased. In addition, assuming that the interval between the terminals in a direction the terminals are arranged is fixed, the width of the housing in this direction can be decreased.

The above and other objects and features of the invention will be more apparent from the following description taken in conjunction with the accompanying drawings.

DESCRIPTION OF THE PREFERRED EMBODIMENTS

Embodiment 1

Figure 1:
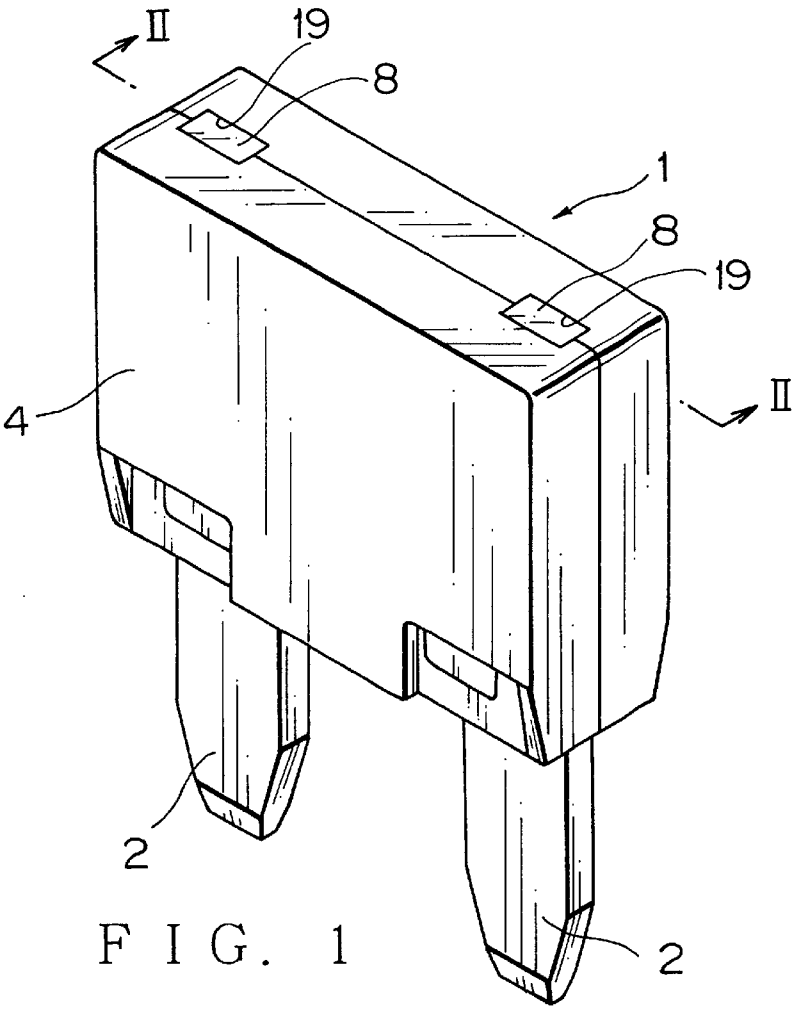
FIG. 1 is a perspective view of a fuse according to a first embodiment of this invention.

Now referring to FIGS. 1 to 3, an explanation will be given of the fuse according to the first embodiment of this invention. A plurality of fuses each according to the first embodiment are mounted in e.g. an electric connection box. As seen from FIGS. 1 and 2, a fuse 1 includes a pair of terminals 2 arranged in parallel to each other, a housing 4 which houses the one ends 3*a* of these terminals and a fusible body 5 which connects the terminals 2 to each other.

The terminal 2 is made of a conductive material, respectively. The terminal 2 is formed in a plate shape. The terminal 2 has a recess (first recess) 6 which serves to increase the distance between both terminals and an attaching hole 7. The terminal 2 is provided so that its one end 3*a* is housed within the housing 4 and its other end 3*b* is exposed outside the housing 4.

Figure 2:
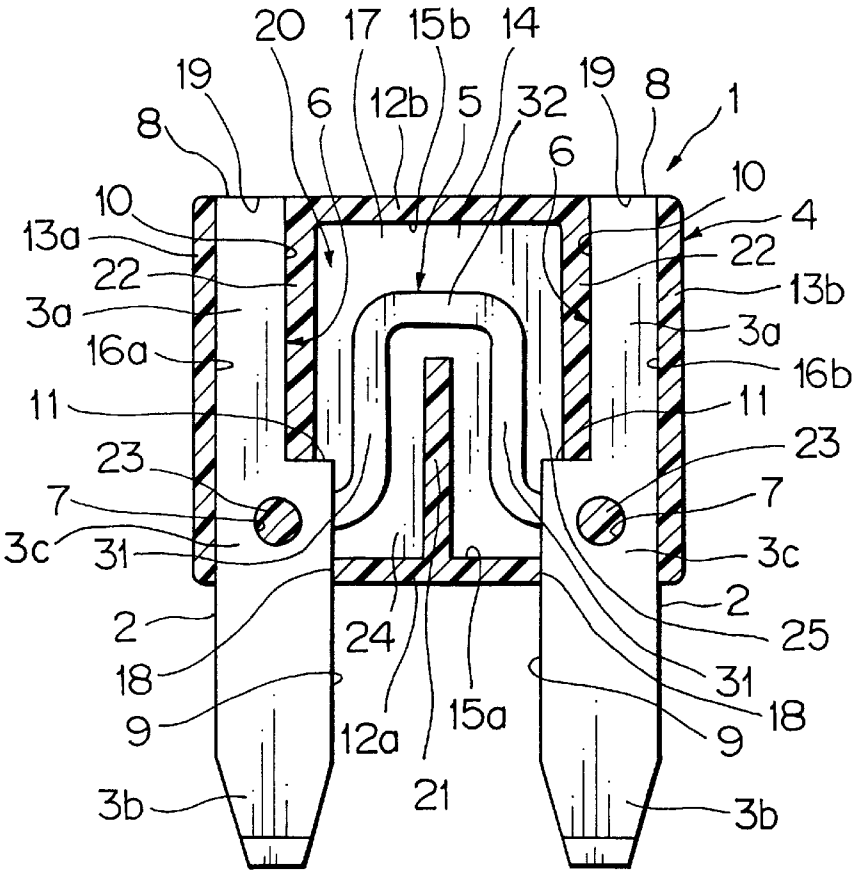
FIG. 2 is a sectional view taken in line II—II in FIG. 1.
Figure 3:
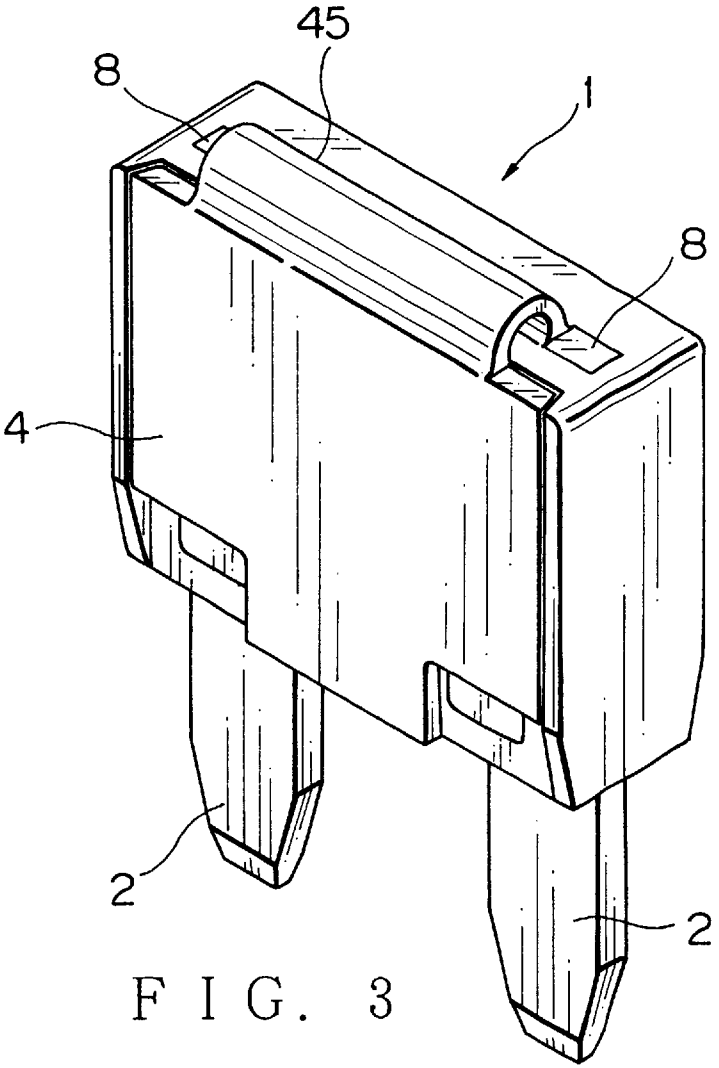
FIG. 3 is a perspective view of a modification of the housing for a fuse shown in FIG. 1.

As seen from FIGS. 2 and 3, the recess 6 is formed at the one end 3*a* of the terminal 2. The recess 6 is formed in concavity from the inner face 9 located at the other end 3*b*. The inner faces 9 of the terminals 2 are opposite to each other when the terminals are arranged in parallel.

The recesses 6 are formed so that the interval between the terminals 2 extend stepwise from the interval between the inner faces 9. The recess 6 includes a flat face 10 and a step face 11. The flat face 10 extends from the end face 8 located at the one end 3*a* of the terminal 2 to the central portion of the terminal 2 in its longitudinal direction. The step face 11 couples the flat face 10 and the inner face 9 with each other.

The flat faces 10 are formed so that the interval therebetween is wider than that between the inner faces 9. The flat faces 10 constitute an inner face in this specification.

The step faces 11 are formed in a direction of arranging the pair of terminals 2 in parallel. The recesses 6 are located within the housing 4 in a state where the terminals 2 have been attached to the housing 4.

The attaching holes 7 are formed so that they penetrate through the terminals 2. The attaching hole 7 is provided at the central potion of the terminal 2 in the longitudinal direction. The attaching hole 7 is circular in section.

When the fuse 1 is mounted in the electric connection box, the terminals 2 are electrically connected to receiving terminals of the box, respectively. One of the receiving terminals 2 is supplied with an electric power whereas the other thereof is electrically connected to various loads. Thus, the one of the terminal 2 is supplied with the electric power through the receiving terminal whereas the other thereof is connected to the loads.

The housing 4 is made of insulating synthetic resin. The housing 4 is formed in a box shape. The interior of the housing 54 constitutes a housing chamber within which the one ends of the above pair of terminals 52 are housed. As seen from FIG. 2, the housing 4 includes a pair of end walls 12*a*, 12*b*, a pair of side walls 13*a*, 13*b* and a pair of frame walls 14. These pairs of walls constitute the outer periphery of the housing 4.

The pair of end walls 12*a*, 12*b* are opposite to each other in a direction crossing the direction of arranging the pair of terminals in parallel. When the terminals 2 are housed in the housing 4, the end wall 12*b* is flush with the end face 8. The pair of end walls 12*a*, 12*b* are also opposite to each other in a direction perpendicular to the direction of arranging the pair of terminals in parallel.

The pair of side walls 13*a*, 13*b* are opposite to each other in the direction of arranging the pair of terminals in parallel. The pair of side walls 13*a*, 13*b* are also formed in the longitudinal direction of the terminals 2. When the one ends of the terminals 2 is housed in the housing 4, the pair of side walls 13*a*, 13*b* externally cover the one ends 3*a* of the terminals 2. The pair of side walls 13*a*, 13*b* serve as an insulating means in this invention.

The pair of frame walls 14 are opposite to each other in a direction crossing the direction of arranging the pair of terminals 2 to each other. The pair of frame walls 14 extend in the longitudinal direction of the terminals 2. The pair of frame walls 14 are communicated with both of the end walls 12*a*, 12*b* and side walls 13*a*, 13*b*, respectively. Incidentally, in FIG. 2, only the frame wall 14 in the inside is shown.

A space 20, which is surrounded by the respective inner faces 15*a*, 15*b* of the end walls 12*a*, 12*b*, respective inner faces 16*a*, 16*b* of the side walls 13*a*, 13*b* and respective inner faces 17 of the frame walls 14, constitutes a housing chamber for housing the one ends 3*a* of the terminals 2. Incidentally, the respective inner faces 15*a*, 15*b* of the pair of end walls 12*a*, 12*b* constitute first inner walls in this specification, and the respective inner faces 16*a*, 16*b* of the pair of side walls 13*a*, 13*b* constitute inner walls in this specification.

The end wall 12*a* which is located at the central portions of the terminals 2 includes a pair of through-holes 18 through which the terminals 2 are passed, respectively. On the other hand, the end wall 12*b* which is located at the end faces of the terminals 2 includes a pair of exposing holes 19 to which the respective end faces of the terminals 2 are exposed, respectively.

The housing 4 includes a pair of terminal position pins 23, a first partition wall 21 and a pair of second partition walls 22. The terminal positioning pins 23 are provided at a position in the vicinity of the side wall 13*a* and close to the end wall 12*a* and another position in the vicinity of the side wall 13*b* and close to the end wall 12*a*.

The terminal positioning pins 23 are provided to protrude from the inner face 17 of at least one of the frame walls 14 in a direction the pair of frame walls 14 approach each other. The terminal positioning pin 23 is adapted to invade the attaching hole 7 of the terminal 2.

In the configuration described above, the one ends 3*a* of the terminals 2 are housed in the housing chamber 20 in a state where the terminal positioning pins 23 of the housing 4 are passed through the attaching holes and located inside the side wall 13*a*, 13*b*. In this case, the terminals 2 are passed through the through-holes 18 of the end wall 12*a* and their end faces 8 are exposed outside from the exposing holes 19, respectively.

The partition wall 21 extends from the inner face 15*a* of the one end wall 12*a* to the inner face 15*b* of the other end wall 12*b*. The partition wall 21 extends in the longitudinal direction of the side walls 13*a*, 13*b* and terminals 2.

The partition wall 21 is formed at a central position between the terminals arranged in parallel. The partition wall 21 extends to a central position between the pair of end walls 12*a*, 12*b*. In this way, the partition wall 21 extends from one of the inner faces 15*a*, 15*b* from the other thereof.

The partition wall 21 partitions the housing chamber 20 formed in the housing 4 into a first chamber 24 which houses the end 3*a* of one of the terminals 2 and a second chamber 25 which houses the end 3*a* of the other of the terminals 2. FIG. 2 shows the first chamber 24 located at the left side and the second chamber 25 located at the right side.

The second partition walls 22 extends from the inner face 15*b* of the end wall 12*b* toward the inner face 15*a* of the end wall 12*a*.

The second partition walls 22 are formed at the edges of the exposing holes 19, respectively. The second partition walls 22 extend in the longitudinal direction of the side walls 13*a*, 13*b* and terminals 2, respectively.

The second partitions 22 each is located between the inner face 16*a*, 16*b* of the side wall 13*a*, 13*b* and the partition wall 21. The second partitions 22 extend to the central position of the pair of end walls 12*a* and 12*b*, and hence between the inner faces 15*a* and 15*b*.

The second partition walls 22 face the flat faces 10 of the terminals 2 in the state where the terminal positioning pins are fit in the attaching holes, and covers to protect these flat faces 10. In this way, the partition walls 22 extend from the inner face 15*b* to the inner face 15*a* and protect the flat surface 10 of the terminal 10. These partition walls 22 constitute protecting portions in the claims.

As seen from FIGS. 2 and 3, the fusible body 5 connects the terminals to each other. The fusible body 5 is formed a liner shape which is square in section. The fusible body 5 has a width, thickness and length enough to fuse when the supplied power exceeds a prescribed current value. In this embodiment, the fusible body 5 and the pair of terminals can prepared using a certain material subjected to rolling, cutting and stamping. In other words, the fusible body 5 and the pair of terminals are formed integrally.

Both ends of the fusible body 5 are coupled with the inner faces 9 of the terminals 2, respectively. The fusible body 5 consists of a pair of extending portions 31 and a coupling portion 32. The extending portions 31 extend from their coupled position with the inner faces 9 of the corresponding terminals 2 toward the end wall 12*b* to leave the terminals 2.

The extending portions 31 are provided at the centers between the partition wall 21 and the corresponding second partition walls 22 in the direction of arranging the terminals 2. The extending portions 31 also extend along the side walls 13*a*, 13*b* and partition walls 21, 22.

The coupling portion 32 couples the ends of the extending portions with each other. The coupling portion 32 is provided between the end walls 12*a* and 12*b* and between their inner faces 15*a* and 15*b*. The coupling portion 32 extends along the inner faces 15*a*, 15*b* of the end walls 12*a*, 12*b*.

Between the coupling position with the one terminal 2 and the coupling position with the other terminal 2, the fusible 5 is formed to bend along the one of the second partition walls 22, inner faces of the end walls 12, 12*b*, partition wall 21 and the other of the second partition walls 22.

In operation, where the fuse 1 having the above configuration is mounted in the electric connecting box, if the current value of the power supplied to one of the terminals 2 through the one receiving terminal exceeds the prescribed current value, the fusible body 5 fuses to stop the supply of the power to the load.

In the fuse 1 according to this embodiment, the recesses 6 of the terminals provides a longer interval between the one ends 3*a* of the terminals 2 than that between the inner surfaces 9*a* of the terminals 2. This assure a large space where the fusible body 5 fused can scatter within the housing chamber 20. Therefore, the fusible body thus fused is difficult to remain between the pair of terminals 2.

Further, the second partition wall 22 protects the flat surface 10 of the terminal 2. Therefore, this second partition wall 22 prevents the fused fusible body 5 from being deposited on the flat surface 10, i.e. the surface of the terminal 2.

Therefore, after the fusible body 4 has fused, the fuse 1 can prevent the pair of the terminals 2 from being communicated with each other. Thus, when the power with a current value which exceeds the fusing current value of the fusible body is supplied, supply of the power to the load can be surely stopped.

The side walls 13*a* and 13*b* externally covers the terminals 2, particularly their one ends 3*a*. Therefore, when the plurality of fuses 1 are mounted in the electric connection box, the adjacent terminals 2 of the fuses can be insulated from each other. Thus, the fuse 1, when mounted in the electric connection box, can be surely connected with various kinds of appliances and power supply connected to the electric connection box in accordance with a desired prescribed pattern.

Figure 4:
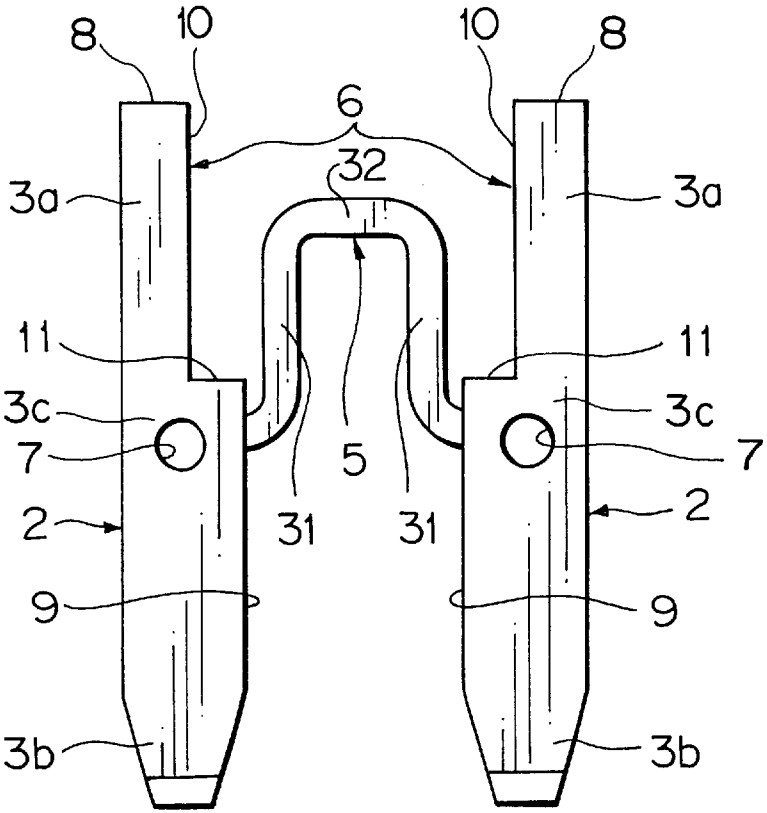
FIG. 4 is a sectional view of the terminals and fusible body of the fuse shown in FIG. 1.

The housing 4 of the fuse 1 according to this embodiment may be provided with a knob 45 as shown in FIG. 4. The knob 45 is formed to protrude outwardly from the edge of the housing 4. By picking up the knob 45, the fuse 1 can be removed from a junction block, relay box or fuse block.

Embodiment 2

Now referring to FIG. 5, an explanation will be given of a second embodiment of this invention. In this embodiment, like reference numerals refer to like elements in the first embodiment. In the fuse 1 according to this embodiment, as seen from FIG. 5, the first partition wall 21 extends from the inner face 15*b* of the end wall 12*b* having the exposing holes 19 toward the inner face 15*a* of the end wall 12*a* having the through-holes 18.

The second partition walls 22 each extends from the inner face 15*a* of the end wall 12*a* toward the inner face 15*b* of the end wall 12*b*. The second partition walls 22 are bent so that the distance therebetween is enlarged stepwise from the inner face 15*a* to the outer face 15*b*.

The second partition walls 22 each consists of a first wall segment 33, a second wall segment 34 and a third wall segment 35. The first wall segment 33 extends from the edge of the through-hole 18 toward the inner face 15*b* of the end wall 12*b* in the longitudinal direction of the terminal 2. The first wall segment 33 extends along the inner face 9 of the terminal 2. The first wall segment 33 covers the inner face 9 located at the central portion 3*c* of the terminal 2.

The second wall segment 34 extends from the end of the first wall segment 33 located apart from the inner face 15*a* in a direction the terminals 2 leave each other. The second wall segment 34 extends along the step face 11. The second wall segment 34 covers the step face 11.

The third wall segment 35 extends from one of the ends of the second segment wall 34 which is located more apart from each other toward the inner face 15*b* of the end wall 12*b* in the longitudinal direction of the terminal 2. The third wall segment 35 extends along the flat face 10 of the recess 6 of the terminal 2 and inner face 16*a*, 16*b*. The third wall segment 35 covers the flat face 10 of the terminal 2. In this way, the second partition walls 22 according to this embodiment each is bent so it extends along the inner face 9, step face 11 and flat face 10 to cover the flat face 10 and others.

Figure 5:
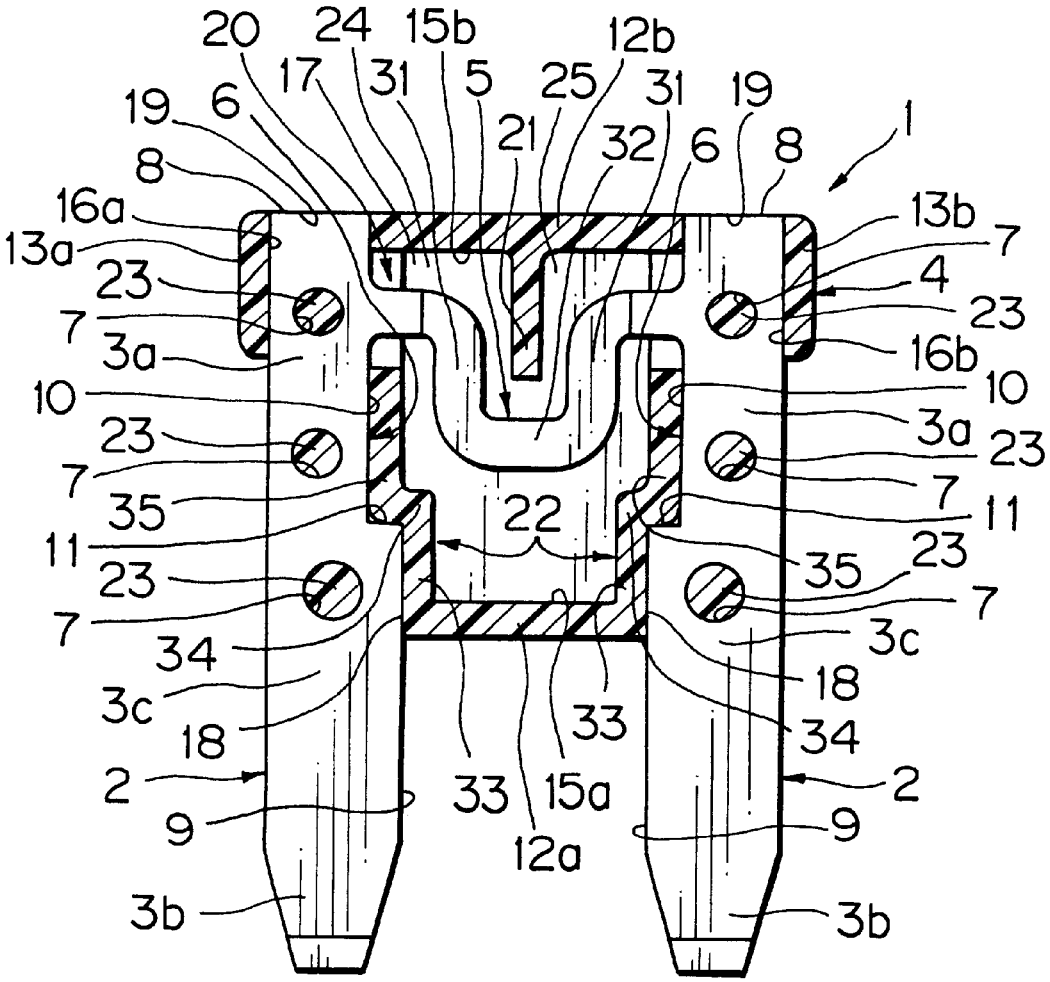
FIG. 5 is a perspective view of a fuse according to a second embodiment of this invention.

The fusible body 5 of the fuse 1 according to this embodiment, as shown in FIG. 5, couples the one ends 3*a* of the terminals 2 with each other. The housing 4 of the fuse according to this embodiment, as seen from FIG. 5, is recessed at the portions close to the other end 3*b* of the side walls 13*a* and 13*b* so that it is externally exposed at the central portion of each of the terminals 2.

In the fuse 1 according to this embodiment, the terminals 2 each has a plurality of attaching holes 7 and the housing 4 has positioning pins 23 corresponding to the attaching holes 7. The attaching holes 7 formed in each of the terminals 2 are arranged in the longitudinal direction of the terminal 2. The attaching pins 23 are adapted to invade the corresponding holes 7. In FIG. 5, three attaching holes 7 are formed in each of the terminals 2.

In accordance with this embodiment, like the first embodiment, provision of the recesses 6 and second partition walls 22 can prevent the pair of terminals 2 from being communicated with each other after the fusible body has fused. Thus, when the power with a current value which exceeds the fusing current value of the fusible body is supplied, supply of the power to the load can be surely stopped.

Since the side walls 13*a* and 13*b* externally cover the terminals 2, particularly their one ends 3*a*, the fuse 1, when mounted in the electric connection box, can be surely connected with various kinds of appliances and power supply connected to the electric connection box in accordance with a desired prescribed pattern.

The pair of terminals 2 and the housing 4 are secured to each other by means of the attaching holes 7 and the corresponding positioning pins 23. This assures fixing between the terminals 2 and the housing 4.

Embodiment 3

Figure 6A:
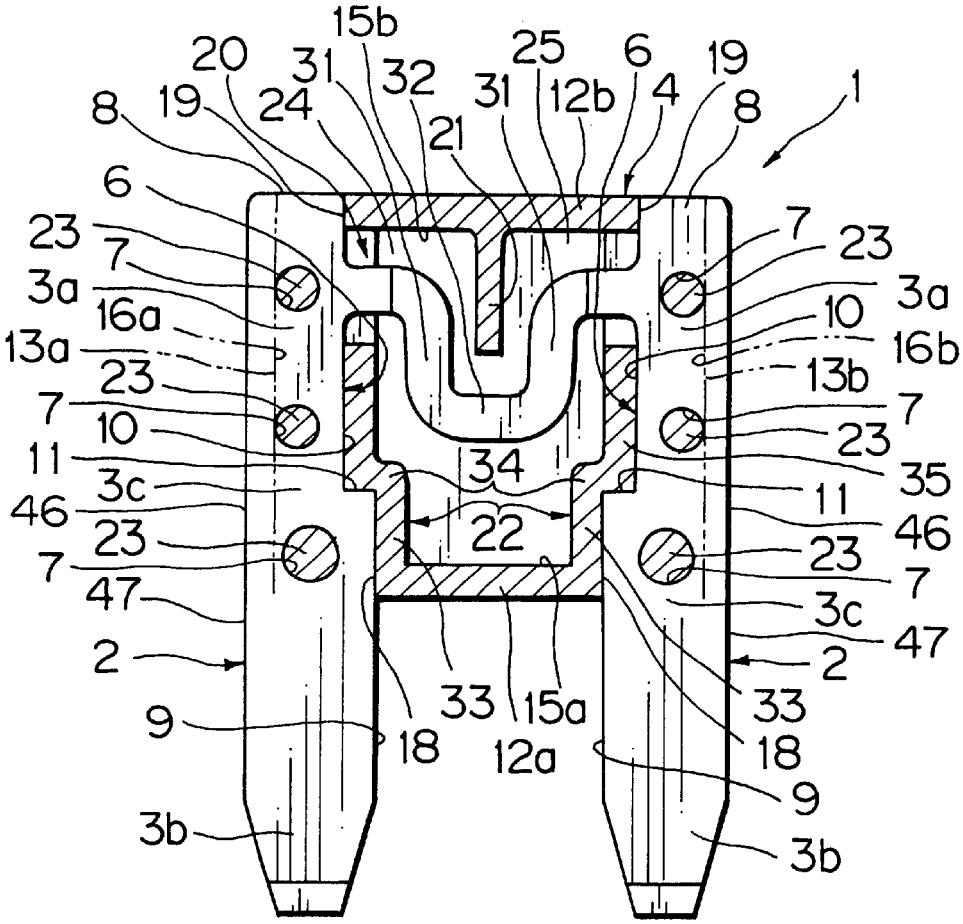
FIGS. 6A and 6B are a sectional view and a side view of a fuse according to a third embodiment of this invention, respectively.
Figure 6B:
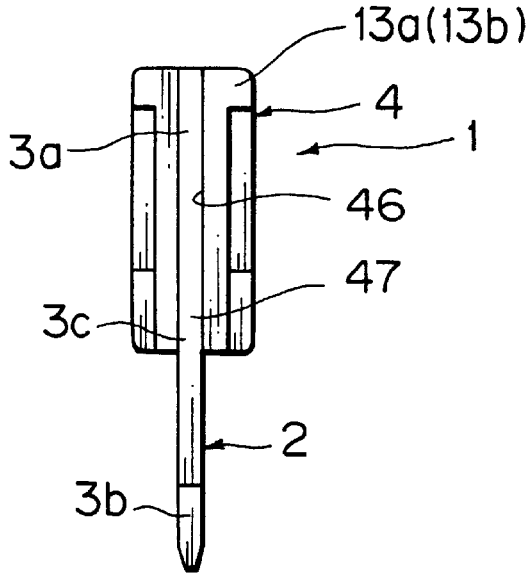

Now referring to FIG. 6, an explanation will be given of a third embodiment of this invention. In this embodiment, like reference numerals refer to like elements in the first and the second embodiment. In the fuse 1 according to this embodiment, as seen from FIGS. 6A and 6B, the housing 4 has exposing windows 46 each exposing the terminal 2 over the one end 3*a* and central portion 3*c*. The exposing window 46 is formed in such a manner that the side wall 13*a*, 13*b* is recessed over the entire length of the terminal 2 in its longitudinal direction. The exposing window 46 exposes the terminal 2 in a state where the outer face 47 is substantially flush with the side wall 13*a*, 13*b*.

In accordance with this embodiment, like the first and second embodiments, provision of the recesses 6 and second partition walls 22 can prevent the pair of terminals 2 from being communicated with each other after the fusible body has fused. Thus, when the power with a current value which exceeds the fusing current value of the fusible body is supplied, supply of the power to the load can be surely stopped.

Assuming that the width of the fuse 1 itself in a direction the terminals 2 are arranged is fixed, since the exposing window 46 exposes the outer face 47 at the one end 3*a* of the terminal 2, the interval between the terminals can be increased. In this case, the space where the fusible body can be scattered can be increased. Accordingly, when the power with a current value which exceeds the fusing current value of the fusible body is supplied, supply of the power to the load can be more surely stopped.

On the other hand, assuming that the interval between the terminals 2 in a direction the terminals are arranged is fixed, the width of the housing 4 in this direction can be decreased. In this case, the fuse 1 can be miniaturized so that the mounting density of the electric connection box in which the fuse 1 is mounted can be improved.

Like the second embodiment, the pair of terminals 2 and the housing 4 are secured to each other by means of the attaching holes 7 and the corresponding positioning pins 23. This assures fixing between the terminals 2 and the housing 4.

Embodiment 4

Figure 7A:
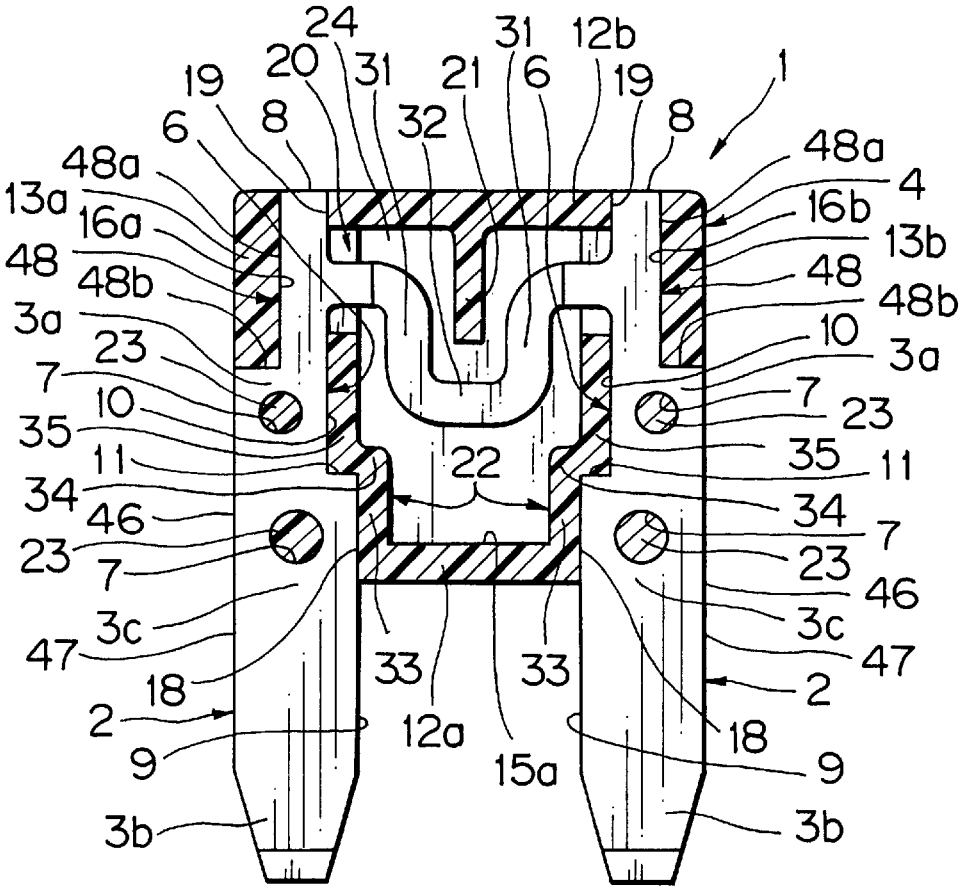
FIGS. 7A and 7B are a sectional view and a side view of a fuse according to a fourth embodiment of this invention, respectively.

Now referring to FIG. 7, an explanation will be given of a fourth embodiment of this invention. In this embodiment, like reference numerals refer to like elements in the first to third embodiments. In the fuse 1 according to this embodiment, as seen from FIG. 7A, the terminals 2 each has a second recess 48. The second recess 48 is formed at the one end 3*a* of the terminal 2.

The second recess 48 is formed in such a fashion that the body of the terminal 2 is partially recessed over its outer face 47 and end face 8. The second recess 48 consists of a first recess face 48*a* which extends from the end face 8 toward the other end 3*b* and a second recess face 48*b* which couples the first recess face 48*a* and the outer face 47 with each other. The first recess face 48*a* extends in the longitudinal direction of the terminal 2. The second recess face 48*b* extends in the direction the terminals are arranged in parallel.

In the fuse according to this embodiment, the side wall 13*a*, 13*b* of the housing 4 is formed along the first recess face 48*a* and second recess face 48*b*. The sidewall 13*a*, 13*b* coincides with the second recess 48. The exposing window 46 of the fuse 1 according to this embodiment, as shown in FIG. 7B, externally exposes the vicinity of the central portion 3*c* of the terminal 2.

In accordance with this embodiment, like the first to third embodiments, provision of the recesses 6 and second partition walls 22 can prevent the pair of terminals 2 from being communicated with each other after the fusible body has fused. Thus, when the power with a current value which exceeds the fusing current value of the fusible body is supplied, supply of the power to the load can be surely stopped.

Figure 7B:
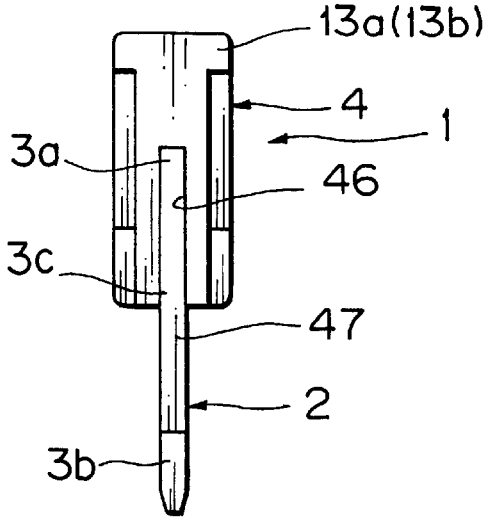
Figure 9:
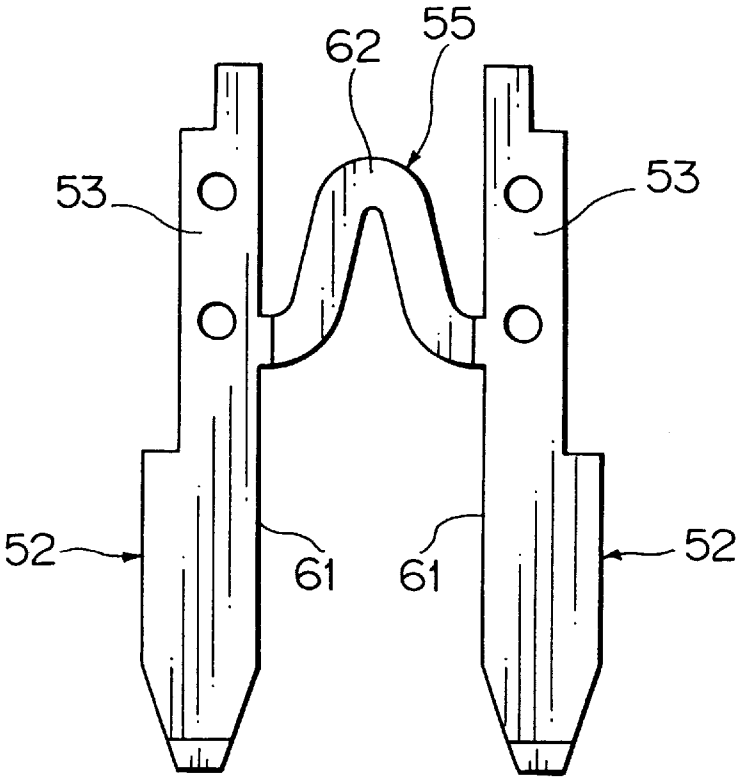
FIG. 9 PRIOR ART
FIG. 9 is a sectional view of the terminals and fusible body of the fuse shown in FIG. 8.
Figure 8:
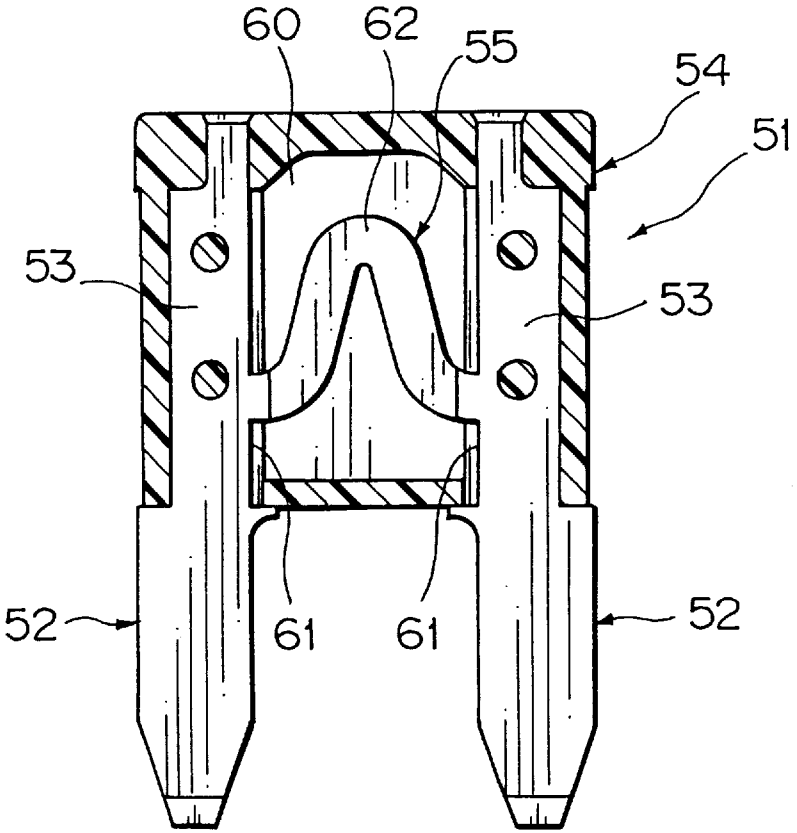
FIG. 8 PRIOR ART
FIG. 8 is a sectional view of the structure of a conventional fuse.

Assuming that the width of the fuse 1 itself in a direction the terminals 2 are arranged in parallel is fixed, as shown in FIG. 7B, since the exposing window 46 exposes the outer face 47 of the terminal 2 and the side wall 13*a*, 13*b* coincides with the second recess 48, the interval between the terminals can be increased. In this case, the space where the fusible body can be scattered can be increased. Accordingly, when the power with a current value which exceeds the fusing current value of the fusible body is supplied, supply of the power to the load can be more surely stopped.

On the other hand, assuming that the interval between the terminals 2 in a direction the terminals are arranged is fixed, the width of the housing 4 in this direction can be decreased. In this case, the fuse 1 can be miniaturized so that the mounting density of the electric connection box in which the fuse 1 is mounted can be improved.

Like the second and the third embodiment, the pair of terminals 2 and the housing 4 are secured to each other by means of the attaching holes 7 and the corresponding positioning pins 23. This assures fixing between the terminals 2 and the housing 4.

In the second to fourth embodiments, the second partition wall 22, although the second partition walls 22 were extended from the inner face 15*a* of the end wall 12*a* to the inner face 15*b* of the end wall 12*b*, they may be extended from the inner face 15*b* to the inner face 15*a*.

In the first to fourth embodiments, although the partition walls 21 and 22 were formed integrally to the inner face 15*a* or 15*b* of the end wall 12*a* or 12*b*, they may be formed integrally to the inner face 17 of the frame wall 14.

In the first to fourth embodiments, although the recesses 6 are provided for the pair of terminals 2, the recess may be provided for at least one of the terminals.

What is claimed is:

1. A fuse including a pair of terminals arranged in parallel, a housing having a housing chamber for housing respective one ends thereof and a fusible body for coupling said pair of terminals with each other, wherein the other ends of the pair of terminals are exposed from the housing and at least one of said pair of terminals has an interval increasing portion where the interval between the one ends of the terminals is made longer than that between the other ends of the terminals, wherein said housing includes a protecting portion for protecting the inner faces of the opposite one ends of said pair of terminals in said entire interval increasing portion.

2. A fuse according to claim 1, wherein said housing includes a pair of inner walls arranged in parallel and perpendicular to said pair of terminals, and said protecting portion are walls which extend from one of the inner walls to the other thereof.

3. A fuse according to claim 1, wherein said housing includes an insulating means for insulating said pair of terminals from each other.

4. A fuse according to claim 3, wherein said insulating means is an outer wall of said housing.

5. A fuse according to claim 1, where said housing includes an outer wall having a window from which the one end of each said terminals is exposed externally.

* * * * *